United States Patent [19]

Sciotti et al.

[11] 4,270,504

[45] Jun. 2, 1981

[54] FUEL BOWL VENT

[75] Inventors: Robert Sciotti, Warren; Michael Dougherty, East Detroit, both of Mich.

[73] Assignee: Colt Industries Operating Corp., New York, N.Y.

[21] Appl. No.: 164,982

[22] Filed: Jul. 1, 1980

Related U.S. Application Data

[63] Continuation of Ser. No. 942,303, Sep. 14, 1978.

[51] Int. Cl.[3] ..... F02M 37/00

[52] U.S. Cl. ..... 123/520; 123/519; 123/518; 137/625.27; 137/625.5

[58] Field of Search ..... 123/518, 519, 520, 521; 137/625.27, 625.5

[56] References Cited

U.S. PATENT DOCUMENTS

| | | | |
|---|---|---|---|
| 1,191,748 | 7/1916 | Valkenburg | 137/625.5 |
| 2,812,776 | 11/1957 | Lofftus | 137/625.27 |
| 3,460,522 | 8/1969 | Kittler | 123/136 |
| 3,683,961 | 8/1972 | Lavnay | 137/625.5 |
| 3,762,443 | 10/1973 | Sorenson | 137/625.27 |
| 3,802,403 | 4/1974 | Dewick | 123/136 |
| 3,835,646 | 9/1974 | Ranft | 137/625.5 |
| 3,844,264 | 10/1974 | Grainger | 123/136 |
| 4,085,721 | 4/1978 | Vardi | 123/136 |

*Primary Examiner*—Charles J. Myhre
*Assistant Examiner*—Carl Stuart Miller
*Attorney, Agent, or Firm*—Walter Potoroka, Sr.

[57] ABSTRACT

A fuel metering device, such as a carburetor for a combustion engine, has a fuel bowl or fuel reservoir with a fuel vapor venting apparatus for, at times, venting such fuel vapors from the interior of the fuel reservoir to, for example, associated canister means. A resiliently deflectable valve member carried as by a stem of an associated solenoid assembly serves to open and close related fuel vapor vent passages. When in one of its operating positions, the valve member is effective for opening a vent passage leading to an associated canister and, when in another of its operating positions, the valve member is effective for opening a vent passage leading to a motive fluid induction passage leading to the associated combustion engine.

3 Claims, 9 Drawing Figures

FUEL BOWL VENT

This is a continuation of application Ser. No. 942,303, filed Sept. 14, 1978.

BACKGROUND OF THE INVENTION

Heretofore, the prior art has, in the main, suggested the use of strictly pneumatically operated fuel bowl vent means for carburetors or the like. Such prior art pneumatically operated fuel bowl vent means are arranged as to be responsive to engine or intake manifold vacuum. That is, the vent means is intended to be closed during all conditions of engine operation because of the existance of associated engine or intake manifold vacuum. Upon engine shut-down, associated biasing spring means serves to open the venting means. However, it has been found that such prior art pneumatic venting systems fail to provide operating characteristics which satisfy engine operating requirements. That is, such prior art pneumatic venting systems open whenever engine or manifold vacuum is low during engine operation such as during, for example, near or at wide open throttle operation. During this time the very low manifold vacuum available to keep the venting system closed is insufficient to overcome the reverse force of the biasing spring means tending to open the venting system. Consequently, such opening of the venting means, during such segments of engine operation, results in a change in the fuel metering pressure differential across the fuel within the fuel reservoir thereby increasing (from a desired rate) the rate of metered fuel flow to the engine (since air cleaner depression increases the total metering differential pressure across the carburetor) and deleteriously effecting engine operation and performance.

Accordingly, the invention as herein disclosed and claimed is primarily directed to the solution of the preceding as well as other related and attendant problems.

SUMMARY OF THE INVENTION

According to the invention, a fuel bowl vent system comprises vent passage means communicating with the interior of a fuel bowl structure and with motive fluid induction passage means as well as with associated canister means, a resilient valve member actuated by related solenoid assembly means to at least two operating positions is effective in one of such operating positions for closing the vent passage means communication as between the interior of the fuel bowl structure and the motive fluid induction passage means and when in another of such operating positions being effective for closing the vent passage means communication as between the interior of the fuel bowl structure and the canister.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted.

DETAILED DESCRIPTION OF THE PREFERRED EMBODIMENT

Figure 1:
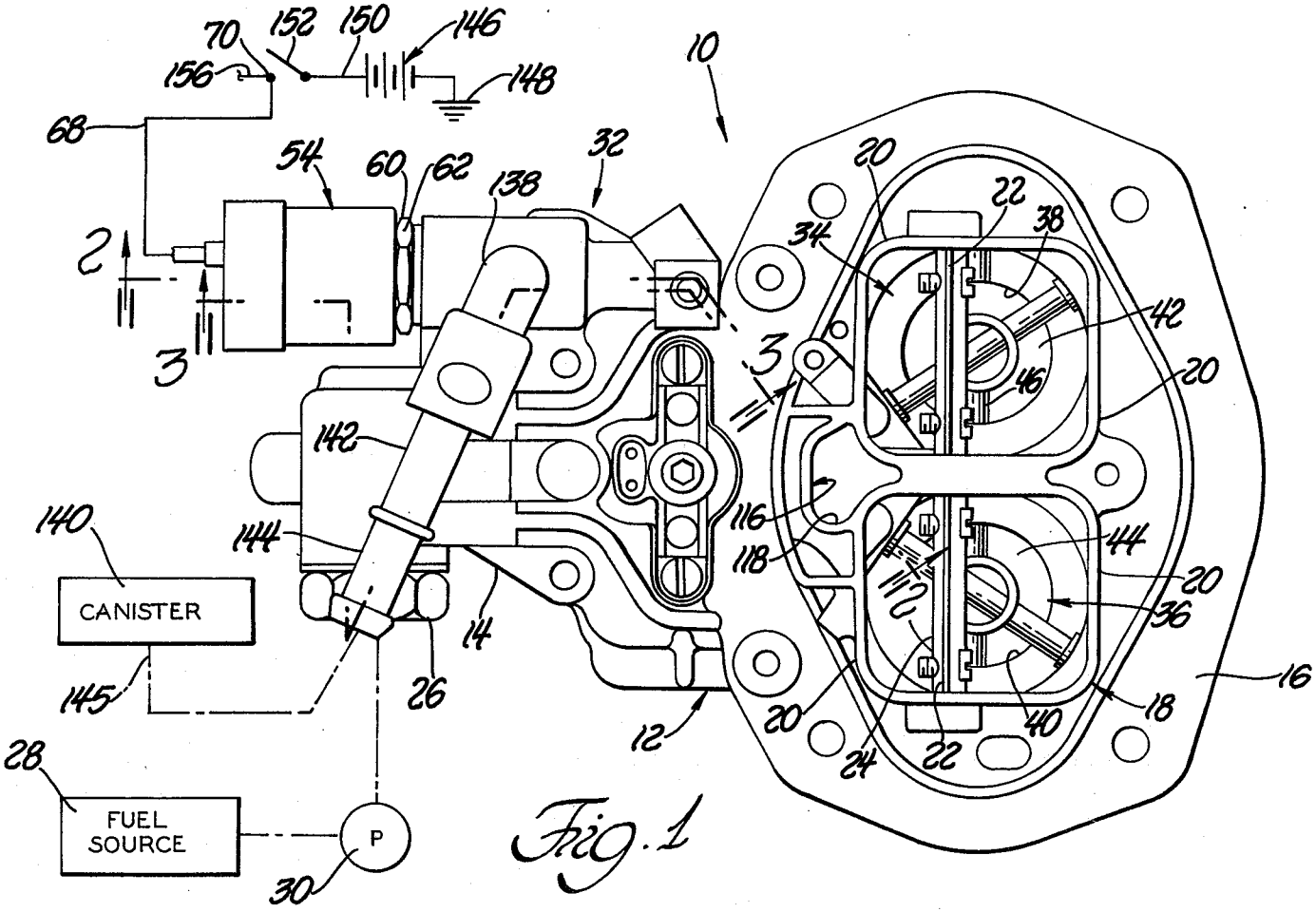
FIG. 1 is a top plan view of a carburetor having fuel bowl vent means employing teachings of the invention.
Figure 2:
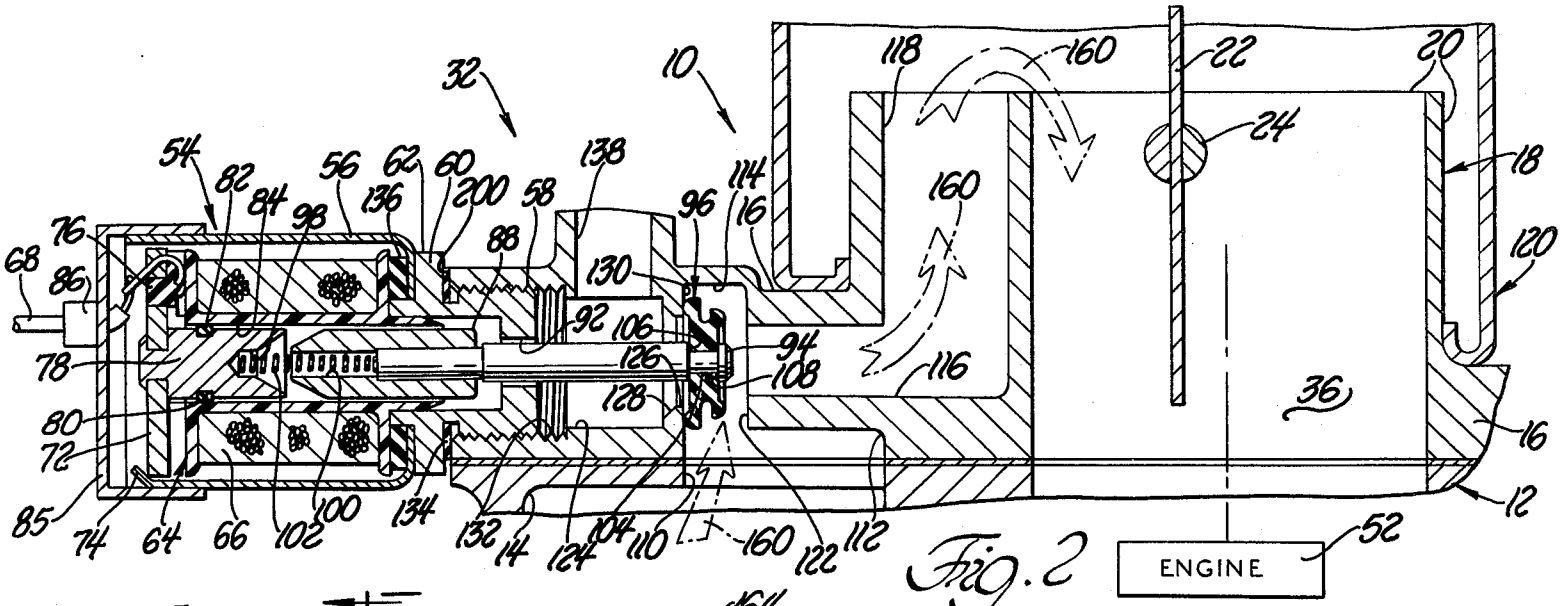
FIG. 2 is an enlarged fragmentary cross-sectional view taken generally on the plane of line 2—2 of FIG. 1 and looking in the direction of the arrows.
Figures 3, 9:
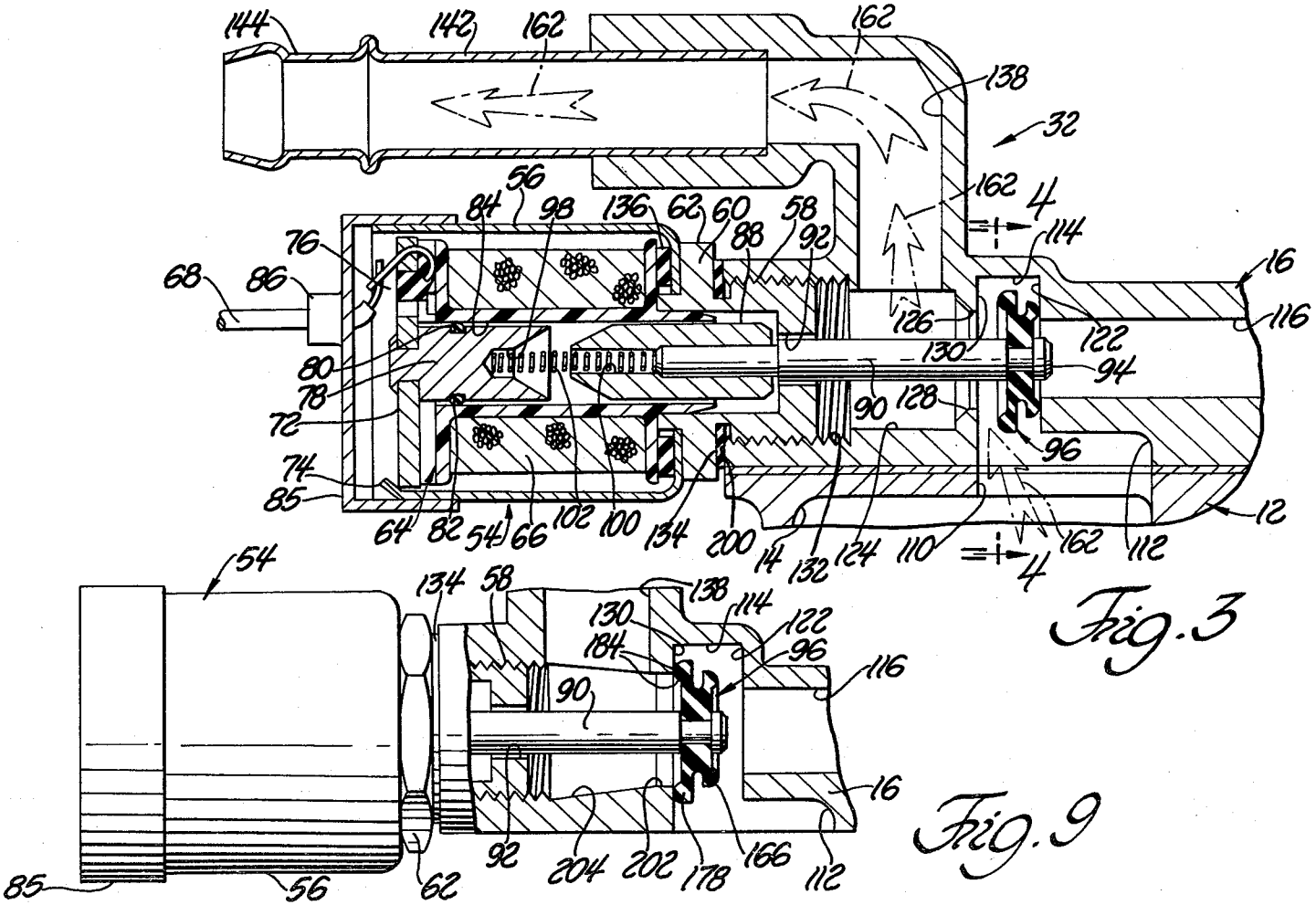
FIG. 3 is an enlarged fragmentary cross-sectional view taken generally on the plane of line 3—3 of FIG. 1 and looking in the direction of the arrows.
FIG. 9 is a fragmentary view, partly in elevation and partly in cross-section, similar to that of FIG. 2 and illustrating a modification.

Referring now in greater detail to the drawings, FIGS. 1, 2 and 3 illustrate a carburetor assembly 10 which may be comprised of a main body 12, having a fuel bowl or reservoir 14 at the left-most portion thereof, and a general cover section 16 which may include an air horn or air inlet portion 18. The air inlet portion 18 may include, as are generally well known in the art, suitable upstanding wall means 20 and a choke valve 22 situated generally therein and carried by a controllably positionable choke shaft 24. Further, the cover section 16 may carry a fuel inlet 26 which, through suitable internally formed fuel passage means, is effective for supplying fuel to the interior of fuel reservoir 14. Such fuel may be derived as from a suitable associated fuel source or tank 28 and fuel supply pump 30. As generally depicted by each of FIGS. 1, 2 and 3, in the preferred embodiment of the invention, fuel bowl vent means 32 is carried as by cover means or section 16.

Not by way of limitation but by way of example, carburetor 10 may have induction passages 34 and 36 formed therethrough with venturi sections 38 and 40, respectively, therein and within the body section 12, along with throttle valves 42 and 44 respectively situated in such induction passages downstream of the venturi sections 38 and 40 and fixedly carried on a rotatable throttle shaft 46 which, in turn, may be provided with suitable throttle actuating control linkage means (not shown but well known in the art). As generally depicted in FIG. 2, the carburetor 10 may be suitably secured atop, for example, intake manifold means of an associated internal combustion engine 52.

As best seen in FIGS. 2 and 3, the venting means 32 is illustrated as comprising a solenoid assembly 54 which, in turn, may be comprised of an outer generally tubular housing portion 56 which, at one end, is provided as with an externally threaded portion or extension and as with a portion 60 provided with suitable tool engaging surface means 62 whereby the assembly 54 may be rotated for threadable engagement with and disengagement from a cooperating portion of the carburetor assembly as, for example, cover means 16.

A generally tubular annular bobbin member 64, situated generally internally of housing 56, carries a field winding 66 which, as is well known in the art, may have one electrical end thereof electrically grounded as through related structure of, for example, body 12 and which may have another electrical end thereof connected as to an electrical conductor 68 leading as to an electrical terminal 70 as shown in FIG. 1. A generally transverse end plate 72 held in assembled condition as by tab portions, one of which is shown at 74, struck from housing 56 and spaced from the spool or bobbin 64 as by spacer means, one of which is shown at 76, supports and maintains a pole piece 78 as to be disposed at least partly generally within the bobbin 64. Preferably, a peripheral groove 80 in piece 78 carries an O-ring type seal 82 which engages and seals as against the inner tubular surface 84 of bobbin 64. A cup-like end cap or cover member 85, suitably secured to housing member 56, carries a grommet 86 through which conductor means 68 passes.

An armature member 88, slidably received within surface 84, is suitably fixedly secured to a rod-like extension 90 which extends through a clearance aperture 92 in threaded housing extension 58 and which, generally at its end 94, carries double-acting sealing means 96. Recesses 98 and 100, respectively formed in pole piece 78 and armature 88, respectively receive opposite ends of a related spring or resilient means 102 as to thereby have armature 88 and rod extension 90 normally resiliently urged to the right as viewed in either FIGS. 2 or 3.

In the preferred embodiment of the invention, sealing means 96 is comprised of resilient material such as, for example, gasoline resistant Buna rubber and, as shown in, for example, FIG. 2, the rod 90 has a necked-down or diametrally reduced portion 104 with axially spaced and opposed annular surfaces 106 and 108 which cooperatingly axially confine sealing means 96 about the reduced portion 104.

The fuel reservoir or bowl 14 is vented as by passage means 110 as to an upper disposed passage 112 which is in continuous communication with a chamber 114 with such passage 112 and chamber 114 being preferably formed in cover portion 16. A conduit means or portion 116, also preferably formed in cover 16, communicates with chamber 114 and has its other end 118 generally open to communication with the inlet of induction passage means 36. Such communication, in the preferred embodiment is completed as within the generally lower portion of a related engine intake air cleaner assembly (many of which are well known in the art) fragmentarily illustrated at 120 operatively connected to the carburetor assembly 10 and generally confining the inlet of the air horn 18. As will be subsequently discussed in greater detail, a wall portion 122 of chamber 114 generally circumscribes the opening of conduit means 116, as it opens into chamber 114, thereby providing for a valve seating surface against which valving means 96 is at times seated in order to thereby terminate communication as between chamber 114 and conduit means 116.

Second chamber means 124, also preferably formed in cover means 16, is adapted for communication with chamber or passage 114 as by interconnecting conduit or passage means 126. In the preferred embodiment, passage means 126 is formed as to provide a generally annular tapered or curvilinear surface 128. Another wall portion 130 of chamber means 114 generally circumscribes the opening of conduit or passage means 126, as it opens into chamber 114, thereby providing for a valve seating surface against which valving means 96 is at times seated in order to thereby terminate communication as between chamber 114 and passage means 126 leading to chamber or passage means 124.

Chamber 124 may be generally axially disposed with respect to solenoid assembly 54 and to internally threaded portion 132 of cover means 16. As should be apparent any tendency for vapors to flow outwardly through the coacting threaded portions 132 and 58 is effectively precluded as by annular seal means 134. Similarly, any tendency for vapors to flow outwardly of chamber 124, between bobbin 64 and threaded housing extension 58 and into the interior of housing 56 is also effectively precluded by annular seal means 136 and O-ring seal 82.

Chamber or passage means 124 is in communication with conduit means 138 which (as best shown in FIGS. 1 and 3) leads to related fuel vapor canister means 140. Conduit means 138 may be provided with an extension 142 having, for example, an end portion 144 formed for operative connection as to generally resilient conduit means 145 leading to remotely situated canister means 140.

FIG. 1 also illustrates a source of electrical potential 146, grounded as at 148, electrically connected via conductor means 150 as to engine ignition switch means 152 which, when closed, completes an electrical circuit to contact 70 and conductors 156 and 68 with conductor 156 leading as to the associated vehicular ignition system (not shown but well known in the art).

OPERATION OF THE INVENTION

During all conditions wherein switch means 152 is closed, coil or winding 66 will be energized causing a magnetic field to be generated which, in turn, causes armature means 88 to move to the left (from the position depicted in FIG. 3) against the resilient resistance of biasing spring means 102. Such leftward movement continues ultimately causing, as generally depicted in FIG. 2, sealing or valving means 96 to sealing engage against coacting valve seating means 130 thereby effectively terminating communication through passage means 126 as between chambers 114 and 124 while, at generally the same time, opening or completing communication as between chamber 114 and passage means 116.

Consequently, with the valving means 96 in the position generally illustrated in FIG. 2 and the engine 52 operating, any fuel vapors within the fuel reservoir or fuel bowl 14 will flow upwardly out of reservoir 14, in a path generally depicted by arrows 160; that is, through opening 110, into chamber or passage 112, into chamber means 114, and into passage means 116 from which, at 118, such fuel vapors exit and are drawn into induction passage means 36 and 34 (also see FIG. 1) to be consumed by the engine 52.

Now, with the valving means 96 in the position depicted in FIG. 2, let it be assumed that the coil or winding 66 is de-energized as by, for example, opening of switch means 152. When this happens, the previously generated magnetic field, of course, ceases to exist and spring means 102 moves armature means 88, stem 90 and valving means 96 to the right (from the position depicted in FIG. 2) with such movement continuing until valving means 96 is sealingly seated against valve seating surface means 122, as generally depicted in FIG. 3, thereby effectively terminating communication as between chamber or passage means 114 and conduit means 116.

Consequently, with the valving means 96 in the position generally illustrated in FIG. 3 and the engine 52 shut-down, any fuel vapors within the fuel reservoir or fuel bowl 14 will flow upwardly out of reservoir 14, in a path generally depicted by arrows 162; that is, through opening 110, into and through opening 110, into and through chamber or passage 112, into chamber or passage means 114, through passage means 126 and into ahd through chamber or passage means 124, and into passage or conduit means 138, 142, 145 leading finally to canister means 140 for, as is known in the art, collecting fuel vapors and condensates thereof. Therefore, with de-energization of solenoid means 54 as during engine shut-down, fuel vapors, instead of flowing into the engine induction passage means, flow into canister means 140.

Figure 6:
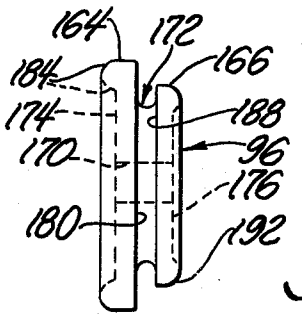
FIG. 6 is a view taken generally on the plane of line 6—6 of FIG. 4 and looking in the direction of the arrows.
Figure 5:
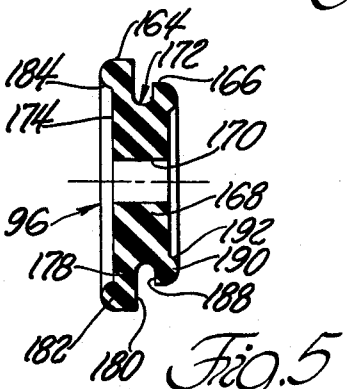
FIG. 5 is a cross-sectional view taken generally on the plane of line 5—5 of FIG. 4 and looking in the direction of the arrows.
Figure 4:
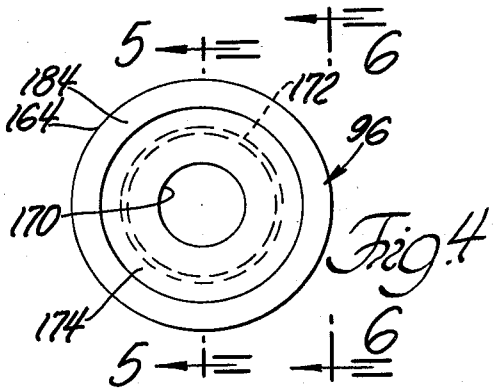
FIG. 4 is a relatively enlarged view of one of the elements shown in FIGS. 2 and 3 and taken generally on the plane of line 4—4 of FIG. 3 and looking in the direction of the arrows.

Referring now in greater detail to FIGS. 4, 5 and 6, in the preferred embodiment, valving means 96 (when viewed in the plane of line 4—4 of FIG. 3) is of a circular configuration having first and second outer circular peripheries 164 and 166, respectively. The main body portion 168 of valving means 96 has a centrally formed generally cylindrical opening or passage 170 formed therethrough for the reception of the necked-down portion 104 of stem 90 (FIGS. 2 or 3). For purposes description, the main body portion 168 may be considered, generally, as being of a disc-like configuration having an outer diameter 172, opposed end faces or surfaces 174 and 176, with an axially extending aperture 170 formed therethrough. A generally annular outwardly radiating first flange portion 178 is integrally formed with main body portion 168 as at one axial end thereof so as to have an outer annular face thereof formed as a planar continuation of end face 174 and an axially inner annular end surface or face 180 blending as into what was considered as the outer diameter 172 of the assumed main body portion 168. The flange portion 178, in turn, has an axially outwardly projecting annular bead-like portion 182 integrally formed therewith and carried thereby. As generally depicted, for example in FIG. 5, the bead portion 182 is preferably provided with a circular or curvilinear contacting surface 184 which when viewed, for example, in axial cross-section, preferably blends at one end with outer periphery 164 of flange portion 182 and which preferably at its other end terminates in the generally planar or end face 174.

A generally annular outwardly radiating second flange portion 186 is integrally formed with main body portion 168 as at the other opposite axial end thereof. Flange portion 186, similarly, has an axially inner annular end surface or face 188, axially spaced from axial end surface 180, blending as into what was considered as the outer diameter 172 of the assumed main body portion 168. Further, flange portion 186, in turn, has an axially outwardly projecting annular bead-like portion 190 integrally formed therewith and carried thereby. As generally depicted, for example in FIG. 5, the bead portion 190 is preferably provided with a circular or curvilinear contacting surface 192 which when viewed, for example, in axial cross-section, preferably blends at one end with outer periphery 166 of flange portion 186 and which preferably at its other end terminates in the generally planar or end face 176.

As previously indicated the valving or sealing means 96 is preferably comprised of relatively resiliently deflectable material as to thereby enable the attainment of the functions and benefits hereinafter described in detail.

Figure 7:
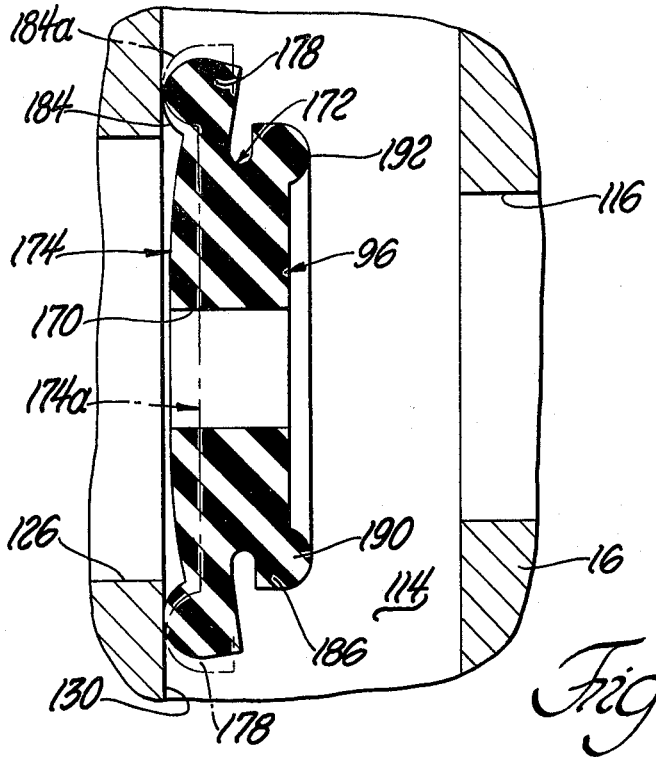
FIG. 7 is an enlarged view similar to FIG. 5 illustrating the configuration assumed by the valving means as during a condition of operation corresponding to that of FIG. 2.
Figure 8:
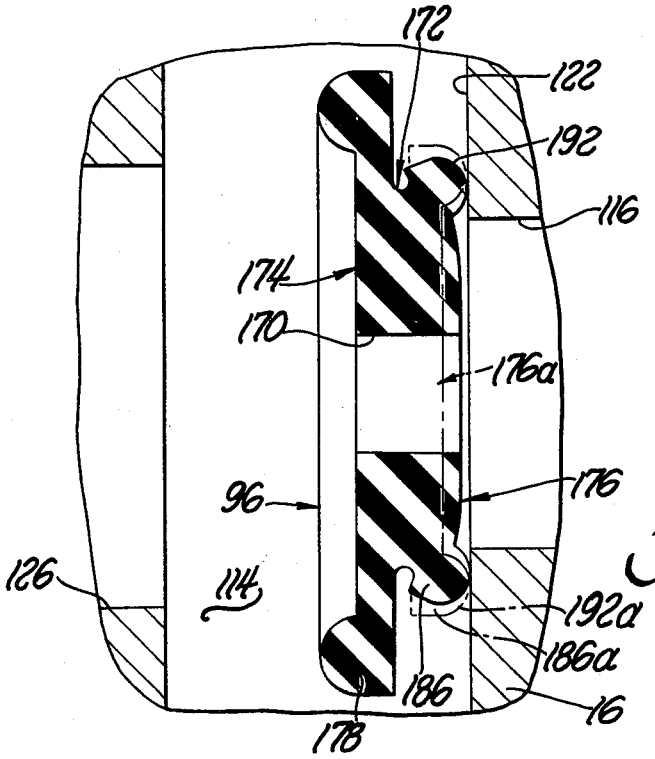
FIG. 8 is an enlarged view similar to FIG. 5 illustrating the configuration assumed by the valving means as during a condition of operation corresponding to that of FIG. 3.

Referring now in greater detail to FIGS. 7 and 8, wherein, primarily, only the valving means 96 and related valve seating surfaces are illustrated, FIG. 7 depicts the configuration attainable by the valving means 96 when the actuating means (solenoid assembly 54) is actuated as generally depicted in and described with reference to FIG. 2. FIG. 8 depicts the configuration attainable by the valving means 96 when the actuating means (solenoid assembly 54) is de-energized as generally depicted in and described with reference to FIG. 3.

First, by way of background and to better convey the benefits of the valving means 96, because of manufacturing tolerances as will always exist as, for example, in the effective length of stroke of the armature and stem 90, the actual relative location of the necked-down portion 104 of stem 90 and its relative position at both ends of the armature stroke, the location of valve seating surfaces 130 and 122 relative to each other and relative to end face 200 of housing cover portion 16, the thickness of seals 134 and 136, the effective thickness at the end of housing portion 56 adjacent seal 136, the effective thickness extension body or housing portion 60, and other dimensions and tolerances of elements internally of housing section 56, it is apparent that the valving means 96 must be capable of effecting a seal even though, as between any two assemblies, the actual plane or surface of sealing may have its location relative to the sealing or valving means 96 altered because of an accumulation of such dimensional manufacturing tolerances.

In the preferred embodiment, referring to FIG. 7, when armature means 88 and stem 90 (shown in FIGS. 2 and 3) are moved as to close passage 126 (the condition depicted in FIG. 2) the valving means 96, in thusly moving to the left, first strikes or engages the valve seating surface 130 and such initial engagement is depicted in phantom line with the relavant surfaces assuming positions and configurations as generally designated at **184*a* and 174*a*. However, because of the relative resiliency of valving means 96 and the, in effect, annular groove or space 172 existing between flange portions 178 and 186, flange portion 178 resiliently flexes in a direction generally toward the spaced flange portion 186 thereby permitting the armature 88 and stem to travel further beyond the point of initial contact. By the time that full movement of armature means 88 and stem 90 is attained, the configuration of the valving means 96 may be that as generally depicted in solid line in FIG. 7. It should be noted that from initial contact and through the entire process of resilient deflection, the sealing surface 184 is held in sealing engagement against valve seating surface means 130. It should be apparent that, as generally depicted in FIG. 7, full sealing by valving means 96 is accomplished anywhere from and including a position corresponding to 174*a* to and including a position corresponding to 174**. This, then, effectively compensates for any changes which may occur in the relative positions or locations of the related elements due to dimensional variations arising out of dimensional manufacturing tolerances.

In the preferred embodiment, referring to FIG. 8, when armature means 88 and stem 90 (shown in FIGS. 2 and 3) are moved as to close passage 116 (the condition depicted in FIG. 3) the valving means 96, in thusly moving to the right, first strikes or engages the valve seating surface means 122 and such initial engagement is depicted in phantom line with the relevant surfaces assuming positions and configurations as generally designated at 192*a*, 186*a* and 176*a*. However, because of the relative resiliency of valving means 96 and, in effect, annular groove or space 172 existing between flange portions 186 and 178, flange portion 186 resiliently flexes in a direction generally toward the spaced flange portion 178 thereby permitting the armature 88 and stem to travel further beyond the point of initial contact. By the time that full movement of armature means 88 and stem 90 is attained, the configuration of the valving means 96 may be that as generally depicted in solid line in FIG. 8. It should be noted that from initial contact and through the entire process of resilient deflection, the sealing surface 192 is held in sealing engagement against valve seating surface means 122. It should be apparent that, as generally depicted in FIG. 8, full sealing by valving means 96 is accomplished anywhere from and including a position corresponding to 176*a* to and including a position corresponding to 176. This, then, effectively compensates for any changes or variations which may occur in the relative positions or locations of the related elements due to dimensional variations arising out of dimensional manufacturing tolerances.

In FIG. 9 a passage or conduit 202, functionally equivalent to passage 126 of FIG. 3, which serves to provide for communication as between chambers or passage means 114 and 204, is preferably of a cylindrical configuration and of a diametral size as to effectively enable the free passing or movement therethrough of the flange portion 186 of valving means 96. That is, preferably, the outer diameter 166 (FIGS. 5 or 6) of valving means 96 would be slightly smaller than the clearance provided for by conduit or passage means 202.

Further, as also depicted in FIG. 9, chamber or passage means 204, functionally equivalent to chamber or passage means 124 (FIG. 3) is preferably formed as to be generally conical or tapered with its widest end portion generally open towards the housing extension 58 and with its narrowest end portion generally communicating with and effectively blending with passage 202. The provision of such a tapered passage 204 is preferred especially in situations, as is herein contemplated, where the solenoid assembly 54, stem or rod 90 and valving means 96 are first pre-assembled and then, as a unit, threadably secured to the related housing or body means 16. That is, in such an arrangement, such a subassembly would be inserted into threaded opening 132 and valve means 96 will pass through the tapered chamber-passageway 204 and passage 202 and ultimately into chamber 114. In thusly passing through the indicated portions, diameter 166 of valve 96 being relatively smaller than passage 202 will not be exposed to any possibility of damage at its sealing surface 167. Diameter 164 of valve 96 being relatively larger will engage at least the tapered surface of chamber or passage means 204; however, it will not be damaged for sealing purposes. That is, the corner 206 of flange portion 178 will, in effect, be the leading edge during such movement toward chamber 114 and as such will be the portion which first engages the surfaces of the passages and chambers. Such engagement, in turn, will cause the relatively resilient annular flange portion 178 to flex and bend in the direction generally toward the relatively trailing armature 88 and in so doing the actual sealing surface 184 will be automatically protected from any possible damage.

Although only one preferred embodiment and a modification thereof have been disclosed and described, it is apparent that other embodiments and modifications of the invention are possible within the scope of the appended claims.

What is claimed is:

1. A fuel bowl vent system for an internal combustion engine having metered fuel supply means, induction passage means and fuel reservoir means, said fuel bowl vent system comprising vent passage means communicating with the interior of said fuel reservoir means with said induction passage means and with associated canister means, solenoid actuating means, resiliently deflectable valve means operatively connected to said solenoid actuating means, said solenoid actuating means being effective to move said valve means to at least first and second operating positions, said valve means being effective when in said first operating position to terminate said vent passage means communication as between said interior of said fuel reservoir means and said induction passage means, and said valve means also being effective when in said second operating position to terminate said vent passage means communication as between said interior of said fuel reservoir means and said associated canister, said metered fuel supply means comprising carburetor means, said carburetor means comprising carburetor-defining body means, said induction passage means extending through said body means, said fuel reservoir means comprising a fuel chamber formed in said body means, said vent passage means comprising first conduit means formed in said body means and communicating with said fuel chamber, first chamber means formed in said body means and communicating with said first conduit means, second conduit means formed in said body means and communicating with said first chamber means and leading to said induction passage means, third conduit means formed in said body means and communicating with said first chamber means and leading to said canister means, said valve means being contained within said first chamber means, said solenoid actuating means comprising valve stem means operatively carrying said valve means, said valve means comprising a generally disc like main body portion, a first annular flange portion integrally formed with said main body portion and radiating outwardly therefrom, a second annular flange portion integrally formed with said main body portion axially spaced from said first annular flange portion and radiating outwardly of said main body portion, a first annular sealing surface carried by said first annular flange portion, and a second annular sealing surface carried by said second annular flange portion, said first and second annular sealing surfaces being directed in directions opposite to each other, said third conduit means comprising second chamber means, said valve stem means extending through said second chamber means, at least a portion of said second chamber means being of a tapered configuration as to have a relatively smaller end, said relatively smaller end being situated generally nearer said first chamber means, said first annular flange portion defining a first outer periphery of relatively small diameter, said second annular flange portion defining a second outer periphery of relatively large diameter, said first annular sealing surface being disposed radially inwardly from said first outer periphery of said first annular flange portion, said second annular sealing surface being disposed radially inwardly from said second outer periphery of said second annular flange portion, said first relatively small diameter permitting said first annular flange portion to undergo at most limited resilient deflection thereof by said second chamber means as said valve means is being inserted into and through said second chamber means to thereby prevent damage to said first annular sealing surface, said second relatively large diameter permitting frictional engagement as between said second annular flange portion and said second chamber means as to thereby cause resilient deflection of said second annular flange portion as said valve means is being inserted into and through said second chamber means to thereby preclude damage to said second annular sealing surface, said second annular flange portion when received in said first chamber means resiliently moving radially outwardly to a normal condition wherein said second annular sealing surface generally circumscribes said second chamber means.

2. A valve element for a valve assembly having spaced first and second axially-aligned and opposed annular valve seats, respectively generally circumscribing openings to first and second conduit means, and wherein said valve element is to be placed into operationally juxtaposed position to said first and second valve seats by physically passing said valve element through said second conduit means, said valve element comprising a generally disc-like main body portion, a first annular flange portion integrally formed with said main body portion and radiating outwardly therefrom, a second annular flange portion integrally formed with said main body portion spaced from said first annular flange portion and radiating outwardly of said main body portion, said first annular flange portion having a first outer periphery the diameter of which is relatively small, said second annular flange portion having a second outer periphery the diameter of which is relatively large, a first annular sealing surface carried by said first annular flange portion, a second annular sealing surface carried by said second annular flange portion, said first annular sealing surface being disposed radially inwardly from said first outer periphery, said second annular sealing surface being disposed radially inwardly from said second outer periphery, said element being formed from a resiliently deflectable material, said valve element being formed with an axially disposed passage adapted for mounting said valve element on the stem of a valve operating device, when being physically passed through said second conduit means said relatively small diameter of said first annular flange portion precludes said first annular flange portion from being resiliently deflected by contact with the surface forming said second conduit means to the degree whereby said first annular sealing surface would be damaged, and when being physically passed through said second conduit means said relatively large diameter of said second annular flange portion being sufficiently large to engage the said surface forming said second conduit means and sufficiently resiliently deflect said second annular flange portion in a direction generally opposite to that in which said valve element is passing through said second conduit means as to thereby protect said second annular sealing surface from damage by contact with said surface forming said second conduit means.

3. A valving assembly, comprising chamber means, first conduit means having a first opening communicating with said chamber means, second conduit means having a second opening communicating with said chamber means, said first and second openings being situated as to be generally oppositely disposed with respect to each other and whereby said chamber means is situated generally between said first and second openings, said first opening having a projected area smaller than the projected area of said second opening, a first valve seating surface generally circumscribing said first opening, a second valve seating surface generally circumscribing said second opening, a valve element of resiliently deflectable material situated in said chamber means, a valving stem operatively carrying said valve element, said valving stem passing through said second conduit means and said second opening, said valve element comprising a main body portion, a first annular flange portion integrally formed with said main body portion and radiating outwardly of said main body portion, a second annular flange portion integrally formed with said main body portion and radiating outwardly of said main body portion, said first and second annular flange portions being axially spaced from each other as to have said first annular flange portion disposed relatively closer to said first opening and said second annular flange portion disposed relatively closer to said second opening, said first annular flange portion having a first outer periphery the outer diameter of which is relatively small, said second annular flange portion having a second outer periphery the outer diameter of which is relatively large, a first axial end face formed on said first annular flange portion disposed as to be generally juxtaposed to and facing said first seating surface, a second axial end face formed on said second annular flange portion disposed as to be generally juxtaposed to and facing said second seating surface, a first annular sealing surface carried by said first axial end face as to be disposed radially inwardly of said first outer periphery, a second annular sealing surface carried by said second axial end face as to be disposed radially inwardly of said second outer periphery, said first annular sealing surface having a mean effective diameter less than the mean effective diameter of said second annular sealing surface, said valving stem when actuated in a first direction being effective to move said valve element toward said first opening and cause said first annular sealing surface to sealingly seat against said first annular seating surface and to cause said first annular flange portion to experience a limited degree of resilient deflection in a direction generally toward said second opening, said valving stem when actuated in a second direction opposite to said first direction being effective to move said valve element toward said second opening and cause said second annular sealing surface to sealingly seat against said second annular seating surface and to cause said second annular flange portion to experience a limited degree of resilient deflection in a direction generally toward said first opening, said relatively small outer diameter of said first outer periphery enabling said valve element to be operatively secured to said valving stem and passed in said first direction through said second conduit means and said second opening and into said chamber means without undue resilient deflection of said first annular flange portion to thereby preclude damage to said first annular sealing surface as might otherwise occur as by contact between said first annular sealing surface and the surface forming said second conduit means, said relatively large outer diameter of said second outer periphery being sufficiently large as to engage the said surface forming said second conduit means and undergo resilient deflection generally in said second direction as said valve element is passed in said first direction through said second conduit means thereby effectively moving said second annular sealing surface generally radially inwardly and away from said surface forming said second conduit means to preclude any damage to said second annular sealing surface as might otherwise occur due to contact as between said surface forming said second conduit means and said second annular sealing surface.

* * * * *